US005311655A

United States Patent [19]

Jager et al.

[11] Patent Number: 5,311,655

[45] Date of Patent: May 17, 1994

[54] METHOD OF MANUFACTURING TITANIUM-ALUMINUM BASE ALLOYS

[75] Inventors: Heimo Jager, Bruck an der Mur; Herbert Puschnik, Kapfenberg, both of Austria

[73] Assignee: Böhler Edelstahl GmbH, Kapfenberg, Austria

[21] Appl. No.: 770,936

[22] Filed: Oct. 4, 1991

[30] Foreign Application Priority Data

Oct. 5, 1990 [AT] Austria ..... A2013/90

[51] Int. Cl.[5] ..... B22D 27/02

[52] U.S. Cl. ..... 29/526.3; 29/527.5; 164/494; 164/495; 164/512; 164/514

[58] Field of Search ..... 164/495, 514, 494, 512; 29/526.2, 526.3, 527.5

[56] References Cited

U.S. PATENT DOCUMENTS

| | | | |
|---|---|---|---|
| 2,686,822 | 8/1954 | Evans et al. | 164/495 |
| 2,734,244 | 2/1956 | Herres | 164/495 |
| 2,763,903 | 9/1956 | Herres | 164/514 |
| 2,800,519 | 7/1957 | Garmy | 164/495 X |
| 2,819,959 | 1/1958 | Abkowitz et al. . | |
| 2,883,721 | 4/1959 | Gorga et al. | 164/495 X |
| 2,892,706 | 6/1959 | Jaffe et al. . | |
| 3,008,823 | 11/1961 | McAndrew . | |
| 3,184,305 | 5/1965 | Poole et al. . | |
| 3,203,794 | 8/1965 | Jaffee et al. . | |
| 3,343,951 | 9/1967 | Peebles . | |
| 4,108,644 | 8/1978 | Walberg et al. | 164/495 X |
| 4,794,979 | 1/1989 | Gassner et al. | 164/495 |
| 4,849,168 | 7/1989 | Nishiyama et al. . | |

FOREIGN PATENT DOCUMENTS

| | | | |
|---|---|---|---|
| 1258114 | 7/1968 | Fed. Rep. of Germany . | |
| 2024349 | 4/1974 | Fed. Rep. of Germany . | |
| 2750606 | 5/1978 | Fed. Rep. of Germany . | |
| 55-149770 | 11/1980 | Japan | 164/514 |
| 63-273562 | 11/1988 | Japan | 164/495 |

OTHER PUBLICATIONS

"Werkstoff-Handbuch Nichteisenmetalle,"0 1960, 2nd Edition, III Ti, VDI-Publishers, Dusseldorf, Germany.

*Primary Examiner*—J. Reed Batten, Jr.
*Attorney, Agent, or Firm*—Sandler, Greenblum & Bernstein

[57] ABSTRACT

The invention is directed to a Titanium-aluminum base alloy articles are produced from pieces of starting materials by melting thereof in a metallic melting crucible having a rotating electrode or a plasma- or electron beam device and there is then accomplished arc remelting, preferably vacuum-arc remelting following the melting of the pieces of starting materials. Furthermore, the arrangement for the manufacture of the articles formed of titanium-aluminum base alloys comprises a melting apparatus containing a rotating electrode or a plasma- or electron beam device and a vacuum-arc melting apparatus.

18 Claims, 1 Drawing Sheet

METHOD OF MANUFACTURING TITANIUM-ALUMINUM BASE ALLOYS

BACKGROUND OF THE INVENTION

1. Field of the Invention

The present invention relates to a new and improved method for the manufacture of metallic alloys for use as preliminary materials, structural articles or components, workpieces or the like, composed of titanium-aluminum base alloys, wherein the melted starting materials are teemed into a mold and the cast element or casting is re-melted. Furthermore, the present invention relates to a new and improved arrangement or apparatus for the manufacture of metallic alloys, especially having an ordered crystal lattice, for use as preliminary materials, structural articles or components, workpieces or the like, composed of titanium-aluminum base alloys with a maximum of 40 to 60 atomic-% titanium and comprising a melting apparatus.

2. Discussion of the Background and Material Information

During the manufacture of titanium-aluminum (Ti-Al) base alloys extreme difficulties presently exist in achieving a sufficient ductility and workability or deformability of the fabricated alloy products or articles. In particular, the high gas content, especially the high oxygen content, of the alloys produced according to conventional techniques, pose difficulties and prevent the attainment of a high ductility and workability or deformability of the fabricated alloys or alloy products. The usual techniques considered acceptable by those skilled in this technology to melt such alloys from pulverulent starting materials and to produce such by an HIP-operation (hot isostatic pressing-operation), have not met with success.

SUMMARY OF THE INVENTION

Therefore, with the foregoing in mind, it is a primary object of the present invention to provide an improved method and arrangement for the manufacture of metallic alloys composed of titanium-aluminum base alloys, in a manner not afflicted with the shortcomings and drawbacks of the prior art.

Another and more specific object of the present invention aims at the provision of an improved method and arrangement for the manufacture of metallic alloys composed of titanium-aluminum base alloys which possess good deformability, without the need to pulverize the starting materials.

Still a further noteworthy object of the present invention is the provision of an improved method and arrangement for the manufacture of metallic alloys composed of titanium-aluminum base alloys which can be produced in a relatively simple and economical fashion, especially by using starting material fragments or pieces.

Another important object of the present invention resides in devising an improved method and arrangement for the manufacture of metallic alloys composed of titanium-aluminum base alloys, wherein it is possible to quite accurately determine the alloy composition of the melt.

It has been completely surprisingly found that there can be manufactured alloy structural articles or components of good deformability if the alloy or alloying components or starting materials are made available or held in readiness in the form of pieces or fragments which essentially correspond in proportion to the alloy composition and are melted in a melting crucible, and the desired alloy composition containing a maximum of 40 to 60 atom-% titanium can be set or adjusted in the melting crucible by the alloying or addition of one or more, if necessary, further alloy components or constituents, and the melt from the melting crucible is cast into elements or articles, advantageously elongate or lengthwise extending blocks or bars or rods which are subsequently self-consumably remelted as an electrode of an arc-melting furnace, preferably in the presence of vacuum conditions, into a compact or dense element, in particular, a compact or dense block or preliminary material for structural articles or components.

The method of the present development affords the advantage that there can be dispensed with the need to pulverize the starting materials and advantageously there can be used as the starting materials fragments or pieces of pure metal and/or pieces of scrap and/or pieces of recycled scrap, in order to produce, as considered from the standpoint of alloying technology, homogeneous electrodes having low gas content. At the same time there can be, however, accomplished an exact setting or adjustment of the alloy composition of the melt, and there exist modest expenditures in the practice of the inventive method.

According to a preferred embodiment of the inventive method, it is contemplated to melt down the starting materials in a cooled metallic, melting crucible equipped with suitable melting means, such as at least one electrode rotating about its lengthwise or longitudinal axis, especially a water-cooled electrode formed of copper, titanium aluminum or an alloy or alloying component, or at least one plasma- or electron beam-melting apparatus, preferably in the presence of a protective gas at reduced pressure. As a result, there is realized an energy-saving melting of the pieces or fragments of the starting materials, without affecting the alloy composition, by an electrode formed of metals which do not adversely affect or influence the alloy properties. Furthermore, due to the employment of the arc or optionally the plasma or electron beam, there is realized a high localized application of energy, namely thermal energy and at the same time a completely homogeneous mixing of the alloy metals, that is, the realization of an orderly crystal arrangement.

According to a further aspect of the inventive method, the blocks or bars or the like, prior to the arc remelting operation, are subjected to a surface treatment or cleaning operation and/or a hot isostatic pressing operation.

Still further, the preliminary materials or elements obtained as a result of the arc melting operation, if necessary following a hot isostatic pressing operation, are subjected to thermal deformation or forming, especially for producing the desired end products.

Exceedingly good results are obtained if the oxygen content of the alloy due to the melting and re-melting, if necessary in conjunction with at least one HIP-operation, is set or adjusted to amount to less than 600 ppm, preferably less than 500 ppm.

An arrangement or apparatus for the manufacture of metallic alloys comprising titanium-aluminum base alloys, according to the present development, is manifested, among other things, by the features that the melting apparatus comprises a cooled metallic melting crucible, preferably formed of copper (Cu), for melting the pieces or fragments of the starting materials. There is used for such melting operation at least one cooled electrode rotating about its lengthwise axis and formed of copper, aluminum, titanium or an alloy component. Furthermore, there is arranged after or downstream of the melting apparatus, a vacuum arc-melting apparatus for the remelting of the castings or cast pieces obtained at a casting station by teeming the melt, received from the melting crucible, into preferably lengthwise extending or elongate molds. In this manner, there is provided a relatively simply constructed arrangement or assembly for the melting of titanium-aluminum base alloys, wherein the manufacture of the alloys can be rapidly accomplished and without enduring large transport paths or distances or energy losses.

A further aspect of the present invention, is the use of an apparatus, more specifically a melting apparatus which comprises a cooled, preferably a liquid-cooled, such as a water-cooled, metallic melting crucible and at least one electrode which extends into or can be inserted into the cooled, metallic melting crucible, wherein, this at least one electrode rotates about its lengthwise axis, is formed of copper, aluminum or titanium or an alloy component, and serves for the melting of pieces or fragments of starting materials for the fabrication of titanium-aluminum base alloys.

BRIEF DESCRIPTION OF THE DRAWING

The invention will be better understood and objects other than those set forth above, will become apparent when consideration is given to the following detailed description thereof. Such description makes reference to the annexed single figure of the drawing depicting therein an exemplary embodiment of an arrangement or apparatus for the manufacture of titanium-aluminum base alloys.

DETAILED DESCRIPTION OF THE PREFERRED EMBODIMENTS

Figure 1:
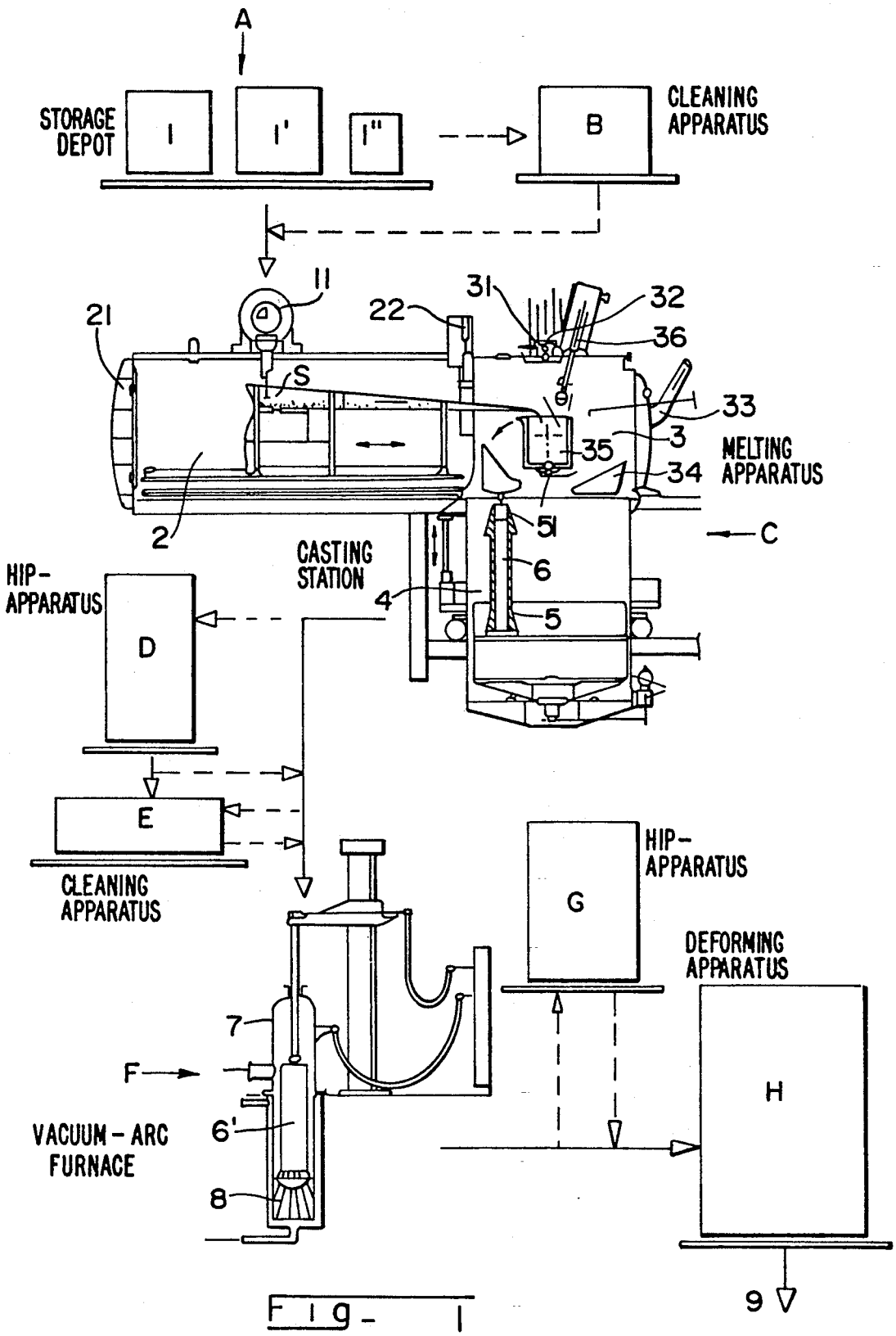

Describing now the drawing, it is to be understood that only enough of the construction of the arrangement or apparatus for the manufacture of titanium-aluminum (Ti-Al) base alloys has been depicted therein, in order to simplify the illustration, as needed for those skilled in the art to readily understand the underlying principles and concepts of the present invention.

Turning now to the single drawing containing FIG. 1, reference character A designates a storage depot or area for fragments or pieces of starting material, for example, in the form of pure metals, pre-alloys, recycled scrap or the like. Specifically, there have been depicted at this storage depot or area A different components, for example, aluminum and/or aluminum-containing scrap 1, titanium and/or titanium-containing scrap 1' and/or chromium scrap and/or scrap 1'' containing alloy or alloying constituents. The amounts of aluminum, titanium and possibly further desired alloying materials or constituents in the starting materials are well known to those skilled in this art, and the admixed starting materials in their aggregate or total approximately result in the desired composition of the alloy.

Continuing, reference character B designates a suitable apparatus for the cleaning of the surfaces of the starting materials. This cleaning apparatus B can comprise, for example, a sandblast unit or blower, a pickling apparatus or any equivalent or other suitable cleaning apparatus.

Reference character C generally designates a melting apparatus. This melting apparatus C comprises a charging chamber or compartment 2 equipped with a door 21 or the like affording access to a vibrating or jarring chute or trough S or equivalent structure. A delivery or feed device 11 introduces the starting materials, which may be possibly comminuted, either from the cleaning apparatus B or directly from the storage depot or area A onto the vibrating chute S. This vibrating chute S conveys the alloy constituents and/or the scrap into a melting crucible 35 which is preferably formed of copper and is appropriately liquid-cooled, for instance, water-cooled. Reference numeral 34 designates slag vats or receivers or the like which, if necessary, can be provided for the melting crucible 35 arranged in a melting chamber 3. An electrode or electrode member 36 can be introduced into the melting crucible 35 arranged in the melting chamber 3. This electrode 36 comprises a cooled, non-consumable electrode which rotates about its lengthwise axis. Any suitable drive can be provided for imparting such rotational movement to the rotatable electrode 36. The rotatable electrode 36 can be suitably mounted to be immersible into the melting crucible 35 and melts the alloy constituents and/or the scrap by forming an arc between the cooled surface of the rotatable electrode 36 and the scrap or molten bath formed in the melting crucible 35.

As also will be seen by further inspecting the single figure of the drawing, reference numeral 31 schematically designates an apparatus for the removal of samples and for the infeed of alloy or alloying constituents for the exact setting of the composition of the melt, reference numeral 32 schematically designates observation or viewing means for observing the melt within the melting crucible 35, and reference numeral 33 schematically designates a vacuum closure or the like provided for the charging chamber 2 which, if necessary, is or can be separated by a sluice 22 from the melting chamber 3.

The melting apparatus C furthermore comprises a casting station 4 within which there are arranged elongate or lengthwise extending molds 5 into which there is teemed the melt or molten bath delivered by the melting crucible 35. The molds 5 which, if necessary, may be pre-heated and/or are appropriately thermally insulated, are provided with an insulating hood or hood member 51, so that there are beneficially eliminated structural stresses and undesired crystallization phenomena.

The lengthwise extending cast products or articles, specifically the elongate blocks or bars 6 formed in the molds 5, are extensively homogeneous and, if necessary, can be delivered to a hot isostatic pressing or simply briefly termed HIP-apparatus D where such elongate blocks 6 or the like are exposed to hot isostatic pressing. Thereafter, at a downstream arranged suitable surface treatment or cleaning apparatus E, the elongate blocks or bars 6 can be subjected to a surface treatment or cleaning operation prior to delivery to a subsequently disposed vacuum-arc furnace F. In this vacuum-arc furnace F the elongate blocks or bars 6 are arranged as electrode blocks 6' in a furnace vessel 7 and remelted by an arc. The thus formed blocks or elements 8 are optionally delivered to a further HIP-apparatus G and thereafter to a deformation or working apparatus H where the blocks are hot-worked or hot-formed. Reference numeral 9 designates the outfeed or removal location where there are removed the finished-fabricated preliminary materials, articles or the like, for further use thereof.

It has been found that it is easily possible to obtain ductile and deformable alloy products having an oxygen content of less than 600 ppm. Without placing any particular requirements upon the starting materials and upon the vacuum-remelting or vacuum-arc furnace apparatus F and upon the melting apparatus C, there can be attained an oxygen content of less than 450 ppm, and a nitrogen content of less than 80 ppm and a hydrogen content of less than 6 ppm, and there is present extremely great alloy homogeneity.

In particular, the fabricated alloy structural articles or components also exhibited an appreciably improved hot-forming or thermal deformability in temperature ranges above 650° C. or 700° C., and these alloy properties or characteristics can not be achieved at all when employing powder-metallurgical manufacture.

While there are shown and described present preferred embodiments of the invention, it is distinctly to be understood the invention is not limited thereto, but may be otherwise variously embodied and practiced within the scope of the following claims.

What is claimed is:

1. A method for manufacturing articles formed of metallic alloys, said metallic alloys being composed of titanium-aluminum base alloys, wherein melted starting materials are teemed into a mold to form a casting and the casting is re-melted, comprising the steps of:

holding in readiness starting materials in the form of pieces which substantially proportionally correspond to an alloy composition of the metallic alloy;

melting the pieces of the starting materials in a melting crucible to form a melt;

adding at least one alloy component to the melt in the melting crucible in order to set a desired alloy composition containing a maximum of 40 to 60 atomic-% titanium;

casting the melt from the melting crucible into a mold to form an ingot for the use as an electrode;

remelting the ingot as a self-consumable electrode of a vacuum arc-melting furnace into a compact remelted ingot;

hot forming the compact ingot obtained from the arc-melting furnace; and adjusting the oxygen content of the metallic alloy obtained by the melting and remelting steps to an amount which is less than 600 ppm.

2. The method according to claim 1, wherein:

the step of remelting the elements as a self-consumable electrode of an arc-melting furnace into a compact ingot serves to form a compact structural article.

3. The method according to claim 1, further including the step of:

using as the starting materials which are held in readiness at least pieces of pure metal.

4. The method according to claim 1, further including the step of:

using as the starting materials which are held in readiness at least pieces of scrap.

5. The method according to claim 1, further including the step of:

using as the starting materials which are held in readiness at least pieces of recycled scrap.

6. The method according to claim 1, further including the step of:

using as the starting materials which are held in readiness at least pieces of preliminary alloys.

7. The method according to claim 1, further including the step of:

surface cleaning the starting materials.

8. The method according to claim 11, wherein:

the step of surface cleaning the starting materials entails sandblasting the starting materials.

9. The method according to claim 11, wherein:

the step of surface cleaning the starting materials entails pickling the starting materials.

10. The method according to claim 1, wherein:

the step of melting the pieces of the starting materials to form a melt in the melting crucible is accomplished in a cooled metallic melting crucible equipped with at least one electrode rotatable about a lengthwise axis of the electrode, and the electrode is formed of a material selected from the group consisting essentially of copper, titanium, aluminum and at least one alloying component.

11. The method according to claim 1, wherein:

the step of melting the pieces of the starting materials to form a melt is accomplished by using a plasma beam.

12. The method according to claim 11, wherein:

the step of melting the pieces of the starting materials to form a melt by a plasma beam is carried out under vacuum in the presence of a protective gas.

13. The method according to claim 1, wherein:

the step of melting the pieces of the starting materials to form a melt is accomplished by using an electron beam.

14. The method according to claim 1, further including the step of:

casting the melt from the melting crucible into a preheated mold in order to reduce the withdrawal of thermal energy and to prevent the formation of structural stresses in the cast elements upon solidification thereof.

15. The method according to claim 14, further including the step of:

using as the pre-heated mold a thermally-insulated mold.

16. The method according to claim 1, further including the step of:

cleaning the surface of the cast ingot prior to remelting the cast ingot in the arc-melting furnace into a compact ingot.

17. The method according to claim 1, further including the step of:

hot isostatically pressing the ingot prior to remelting the ingot in the arc-melting furnace into a compact ingot.

18. The method according to claim 1, further including the step of:

adjusting the oxygen content of the metallic alloy obtained by the melting and remelting steps to an amount which is less than 500 ppm.

* * * * *